US012796814B2

(12) United States Patent
Tang

(10) Patent No.: US 12,796,814 B2
(45) **Date of Patent: *Nov. 17, 2026**

(54) STORAGE SHELF

(71) Applicant: MALZINE CO., LTD., Lukang Towns, Changhua County (TW)

(72) Inventor: Pao-Hsun Tang, Lukang Township, Changhua County (TW)

(73) Assignee: MALZINE CO., LTD., Lukang Township, Changhua County (TW)

( * ) Notice: Subject to any disclaimer, the term of this patent is extended or adjusted under 35 U.S.C. 154(b) by 2 days.

This patent is subject to a terminal disclaimer.

(21) Appl. No.: 18/792,369

(22) Filed: Aug. 1, 2024

(65) Prior Publication Data

US 2025/0351961 A1 Nov. 20, 2025

(30) Foreign Application Priority Data

May 16, 2024 (TW) ..... 113118185

(51) Int. Cl.
*A47B 96/02* (2006.01)
*A47B 96/20* (2006.01)

(52) U.S. Cl.
CPC ..... *A47B 96/021* (2013.01); *A47B 96/201* (2013.01); *A47B 96/205* (2013.01)

(58) Field of Classification Search
CPC ... A47B 96/021; A47B 96/201; A47B 96/205; A47B 13/083; A47B 2013/085; A47B 13/086; A47B 2200/0004
USPC ..... 211/134; 108/90, 27
See application file for complete search history.

(56) References Cited

U.S. PATENT DOCUMENTS 2,913,128 A * 11/1959 Milner ..... A47B 55/02 D6/675.2
3,832,957 A * 9/1974 Mendenhall ..... A47B 96/021 108/108
3,964,404 A * 6/1976 Mueller ..... A47B 57/265 D25/1
3,998,069 A * 12/1976 Kronenberger ..... F25D 17/045 211/183
4,467,927 A * 8/1984 Nathan ..... A47B 87/0223 211/186
5,228,581 A * 7/1993 Palladino ..... F25D 25/02 108/90
5,538,147 A * 7/1996 Fucci ..... A47F 5/01 108/90

(Continued)

FOREIGN PATENT DOCUMENTS

JP 3247820 U * 8/2024 ..... A47B 47/0083

*Primary Examiner* — Jonathan Liu

(57) ABSTRACT

A storage shelf has a storage board. The storage board has a main body, a frame, and a layering plate. The main body has a plurality of socket rings, a grid layer horizontally disposed among the socket rings. The frame has a plurality of framing units, and each framing unit has an edge wing lower than a top surface of the framing unit. A plurality of rib slots are disposed on a surface of the framing unit, and the framing unit has a plurality of combining pieces attached onto an inner surface of the framing units and bonded to connect the plurality of framing units together. The frame further has a plurality of ring grooves for engaging with the socket rings. The layering plate is a solid board and configured to be placed on the edge wings.

5 Claims, 8 Drawing Sheets

(56) References Cited

U.S. PATENT DOCUMENTS

| | | | | |
|---|---|---|---|---|
| 5,913,501 | A * | 6/1999 | Heuss | A47F 3/14 248/346.07 |
| 6,386,657 | B1 * | 5/2002 | Frifeldt | A47B 55/02 211/186 |
| D460,850 | S * | 7/2002 | Giampavolo | D34/38 |
| 6,725,785 | B2 * | 4/2004 | Wang | A47B 13/08 108/90 |
| 8,789,475 | B1 * | 7/2014 | Giampavolo | B65D 19/38 108/54.1 |
| 9,149,119 | B2 * | 10/2015 | Hansel | A47B 96/021 |
| 9,585,475 | B2 * | 3/2017 | Tines | A47B 47/04 |
| 10,299,590 | B2 * | 5/2019 | Olson | A47B 96/021 |
| 10,603,749 | B2 * | 3/2020 | Cheng | B23K 33/004 |
| 11,096,486 | B1 * | 8/2021 | Ke | A47B 57/34 |
| 11,337,522 | B2 * | 5/2022 | Cao | A47B 96/021 |
| 11,576,489 | B1 * | 2/2023 | Ke | A47B 96/02 |
| 2006/0180056 | A1 * | 8/2006 | Dorholt | A47B 13/086 108/90 |
| 2008/0017600 | A1 * | 1/2008 | Thompson | A47F 5/0043 211/119.003 |
| 2009/0189045 | A1 * | 7/2009 | Peckovich | A47B 13/083 108/27 |
| 2016/0120313 | A1 * | 5/2016 | Tang | A47B 47/0091 211/134 |
| 2018/0372136 | A1 * | 12/2018 | Cheng | A47B 96/024 |

* cited by examiner

STORAGE SHELF

BACKGROUND OF THE INVENTION

Field of Invention

The present invention relates to a storage shelf.

Description of the Related Art

In the conventional structure of the storage board, most of the storage boards are mostly a grid layer, in order to enhance the structure of the storage board and allow to accept a solid board for easy storage, and to hide the sharp edge of the grid layer to prevent being cut by the edges, as shown in FIGS. 9 and 10, a frame edge 90 is added on the edge of the storage board. The frame edge 90 is composed of several edge wings 91, the edge wing 91 has several corresponding convex portions 92 or grooves 93 on the side of the edge wing 91, and the corresponding convex portions 92 are embedded in the grooves 93 and then welded to help the edge wing 91 to be combined with each other. When the frame edge 90 is placed on the edge of the storage board, the effect of edge sealing and edge wrapping can be achieved, and the frame edge 90 can be used to enhance the structure and place the solid board.

However, the conventional storage board structure also has the following problems: it is difficult to control the gap between the edge wings 91 of the frame with the convex portion 92 is engaged in the mating groove 93, and it is not only difficult to weld, but also affects its performance. The quality of the welding connection also makes the weld marks quite obvious on the surface, which has a negative impact on the combination and use of the frame edge 90 and also affects its appearance.

Therefore, it is desirable to provide a storage shelf structure to mitigate and/or obviate the aforementioned problems.

SUMMARY OF THE INVENTION

An objective of present invention is to provide a storage shelf structure, which is capable of improving the above-mention problems.

In order to achieve the above-mentioned objective, a storage shelf has a storage board. The storage board has a main body, a frame, and a layering plate. The main body has a plurality of socket rings, a grid layer horizontally disposed among the socket rings. The frame has a plurality of framing units, and each framing unit has an edge wing lower than a top surface of the framing unit. A plurality of rib slots are disposed on a surface of the framing unit, and the framing unit has a plurality of combining pieces attached onto an inner surface of the framing units and bonded to connect the plurality of framing units together. The frame further has a plurality of ring grooves for engaging with the socket rings. The layering plate is a solid board and configured to be placed on the edge wings.

Other objects, advantages, and novel features of invention will become more apparent from the following detailed description when taken in conjunction with the accompanying drawings.

DETAILED DESCRIPTION OF PREFERRED EMBODIMENT

Figure 1:
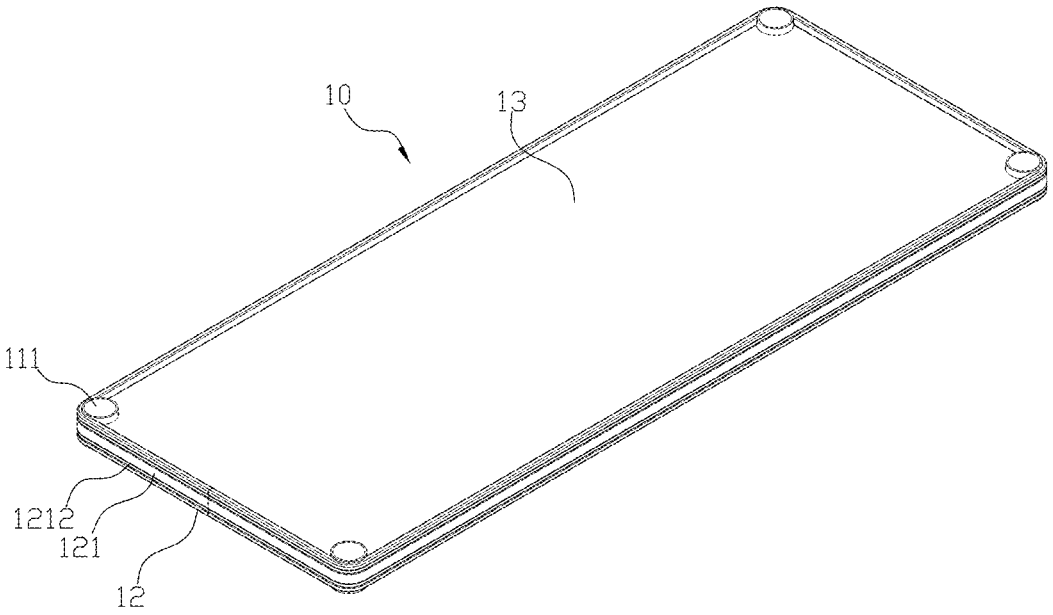
FIG. 1 is a perspective view of a preferred embodiment according to the present invention.
Figure 2:
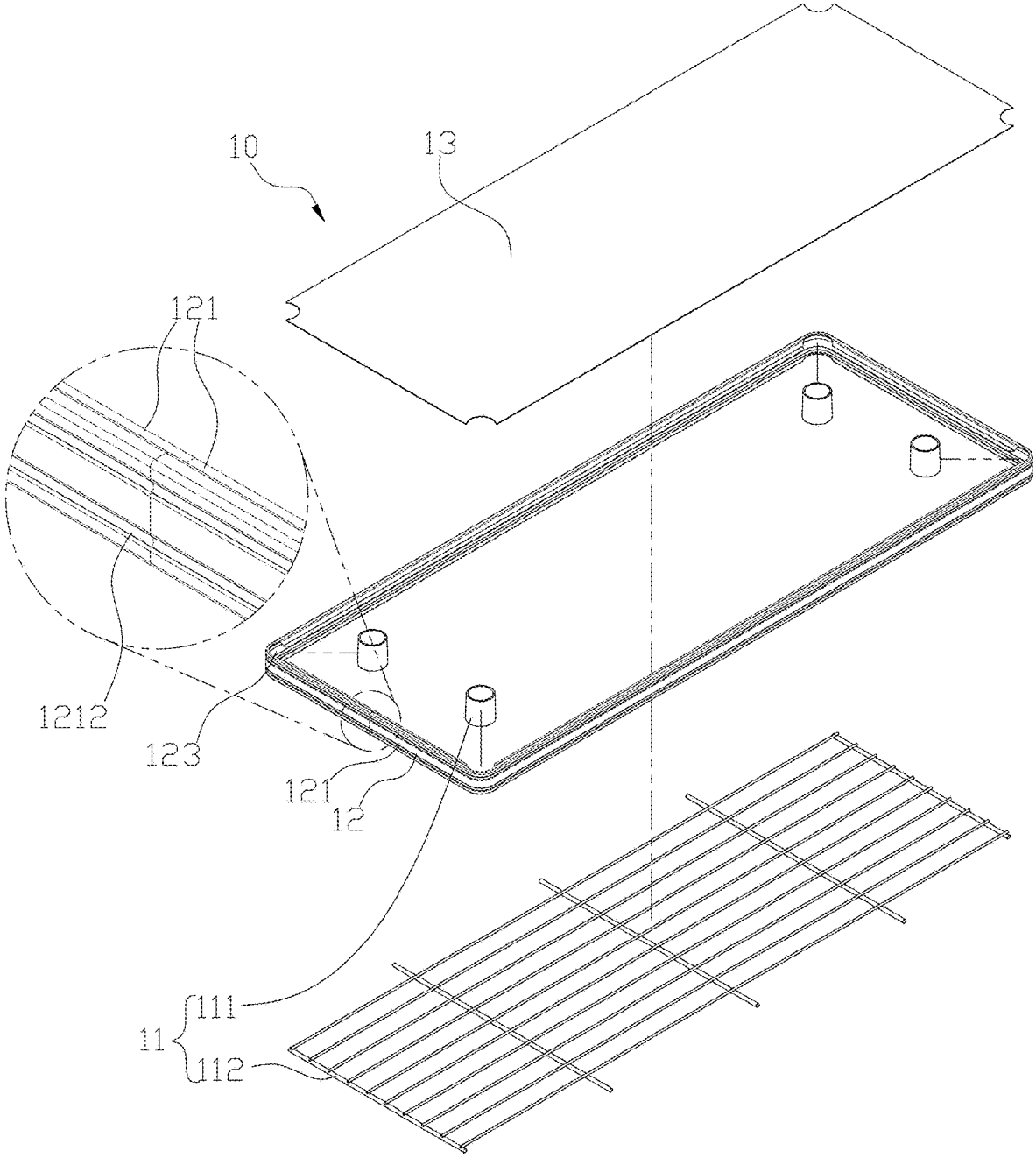
FIG. 2 is an exploded view of the preferred embodiment according to the present invention.
Figure 3:
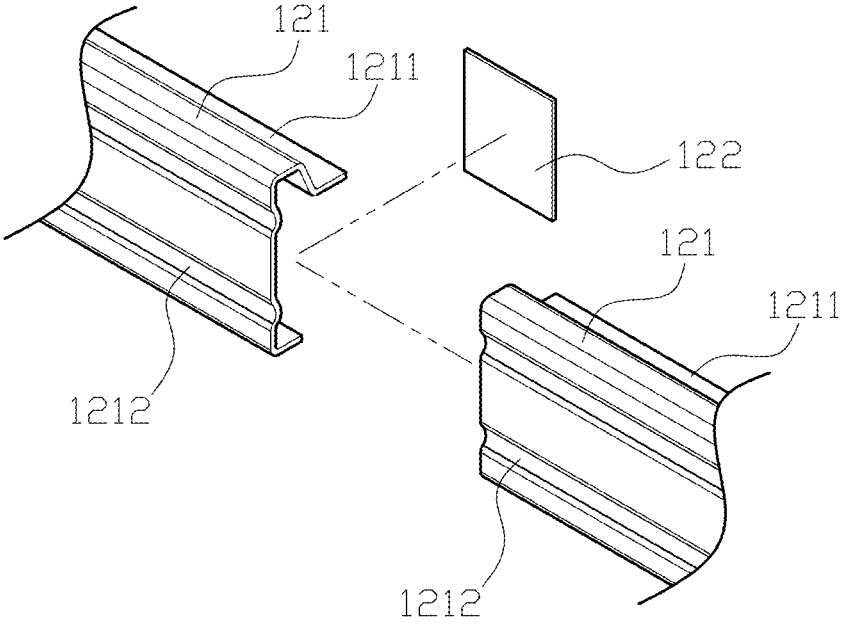
FIG. 3 is a schematic diagram of the combination of the framing units of the preferred embodiment according to the present invention.
Figure 4:
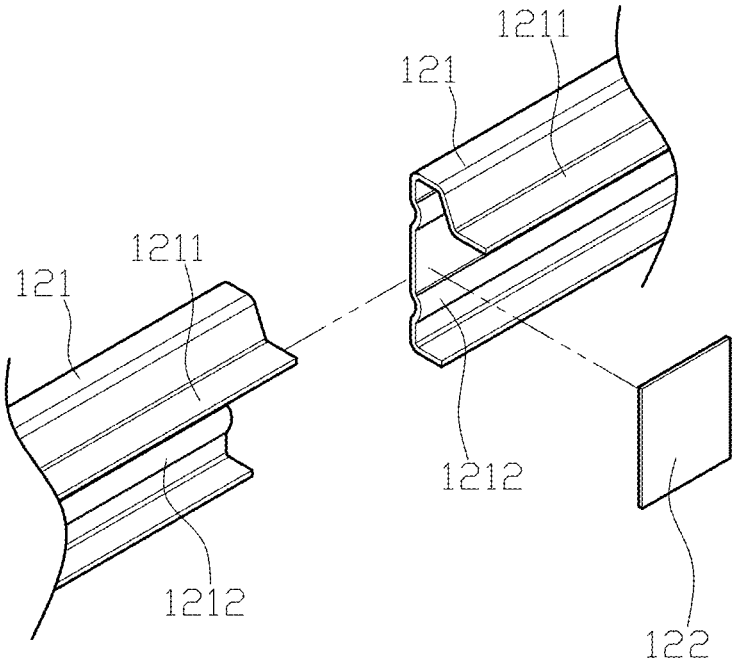
FIG. 4 is a schematic diagram of the framing unit of the preferred embodiment according to the present invention from another angle.
Figure 5:
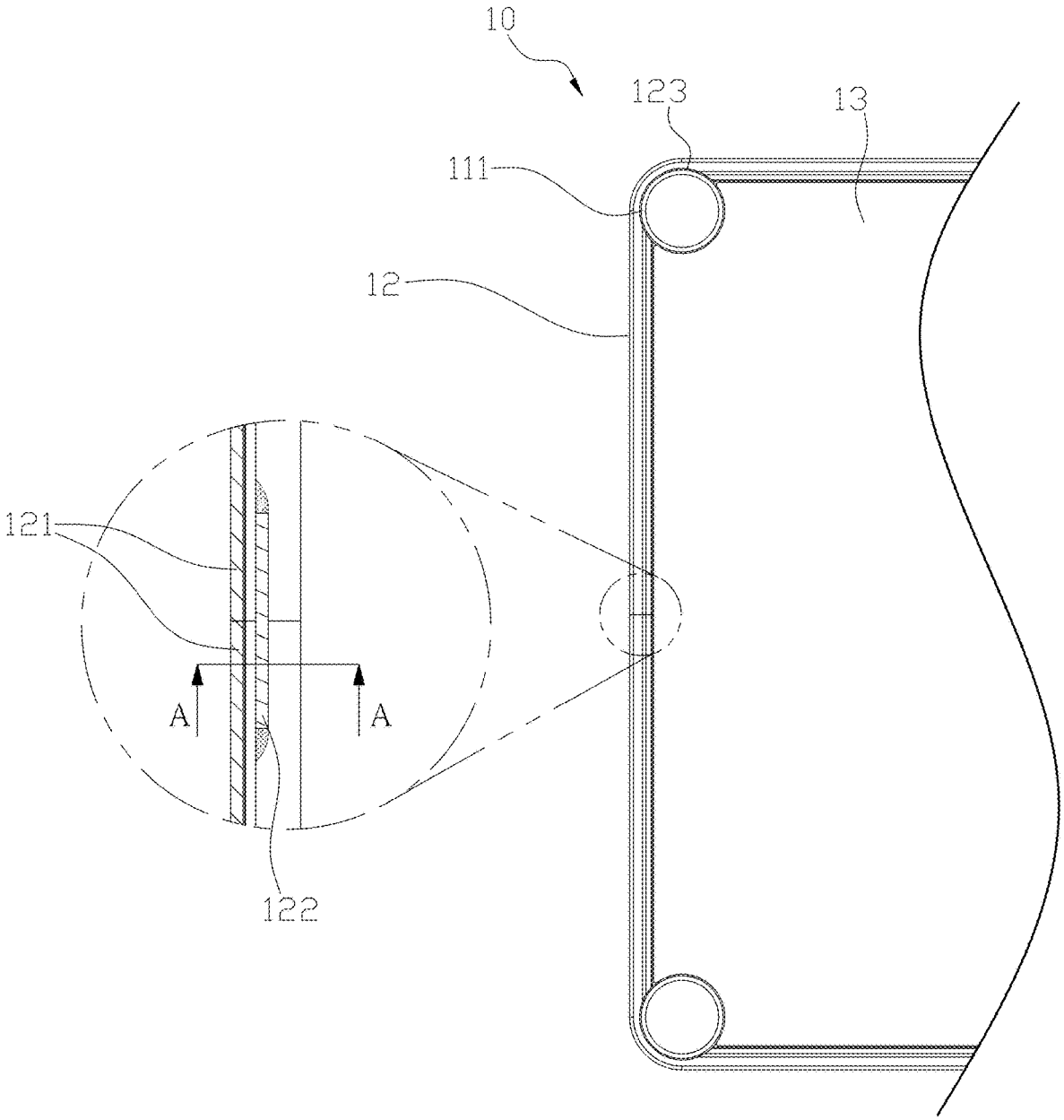
FIG. 5 is a top view of the preferred embodiment according to the present invention.

First, please refer to FIGS. 1-5. A storage shelf comprises a storage board 10, and the storage board 10 comprises a main body 11, a frame 12 and a layering plate 13. The main body 11 has a plurality of socket rings 111 and a grid layer 112 horizontally disposed among the socket rings 111. The frame 12 has a plurality of framing units 121, each of the framing units 1211 has an edge wing 1211 lower than a top surface of the framing unit 121, and a plurality of rib slots 1212 on a surface of the framing unit 121. The framing unit 121 has a plurality of combining pieces 122 attached onto an inner surface of the framing unit 121 and bonded to connect the plurality of framing units 121 together. The frame 12 further comprises a plurality of ring grooves 123 for engaging with the socket rings 111. Furthermore, the layering plate 13 is a solid board and configured to be placed on the edge wings 1211, to complete the assembly of the storage board 10.

With the above-mentioned structure, the framing unit 121 is attached and welded to the inner surfaces of the two framing units 121 through the combining piece 122, thereby having a larger contact area for easy welding, making it easier to combine the framing units 121. Furthermore, the combining piece 122 is hidden inside the framing unit 121, making the surface of the frame 12 smooth without welding marks, and the ring groove 123 is engaged with the socket ring 111 to reliably fix the frame 12 onto the main body 11, so the rib slot 1212 and the edge wing 1211 formed by the inward height difference have the enhancing effect to the structural strength.

When in actual application, without the layering plate 13, items placed directly on the grid layer 112 can be more breathable. When the layering plate 13 is used, small items can be prevented from falling through the holes of the grid layer 112 and storage safely on the solid layering plate 13. The socket ring 111 can be placed around a plurality of supporting rods, so that multiple storage boards 10 can be used for storage at different heights.

Moreover, since the edge wing 1211 is lower than the top surface of the framing unit 121 and has a height difference, it is easier to place the layering plate 13 and prevent the layering plate 13 from being displaced.

Figure 6:
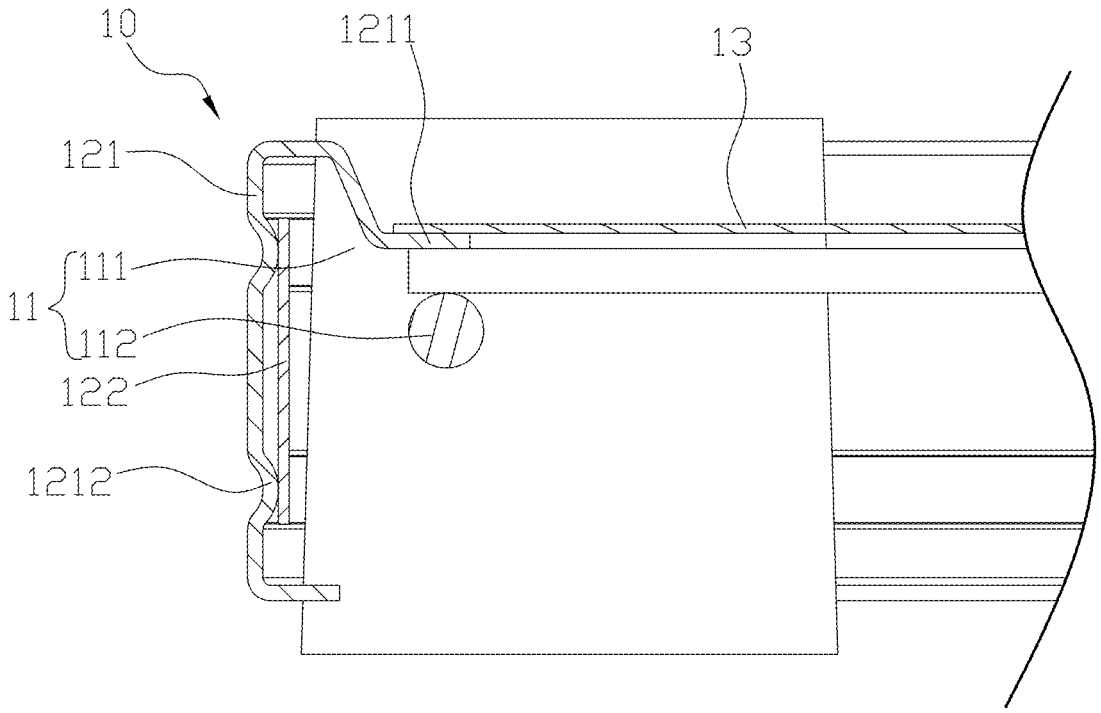
FIG. 6 is the A-A cross-sectional view in FIG. 5 of the preferred embodiment according to the present invention.

As shown in FIG. 6, the combining piece 122 is a flat piece and capable of being welded onto an inner surface of the rib slots 1212.

Figure 7:
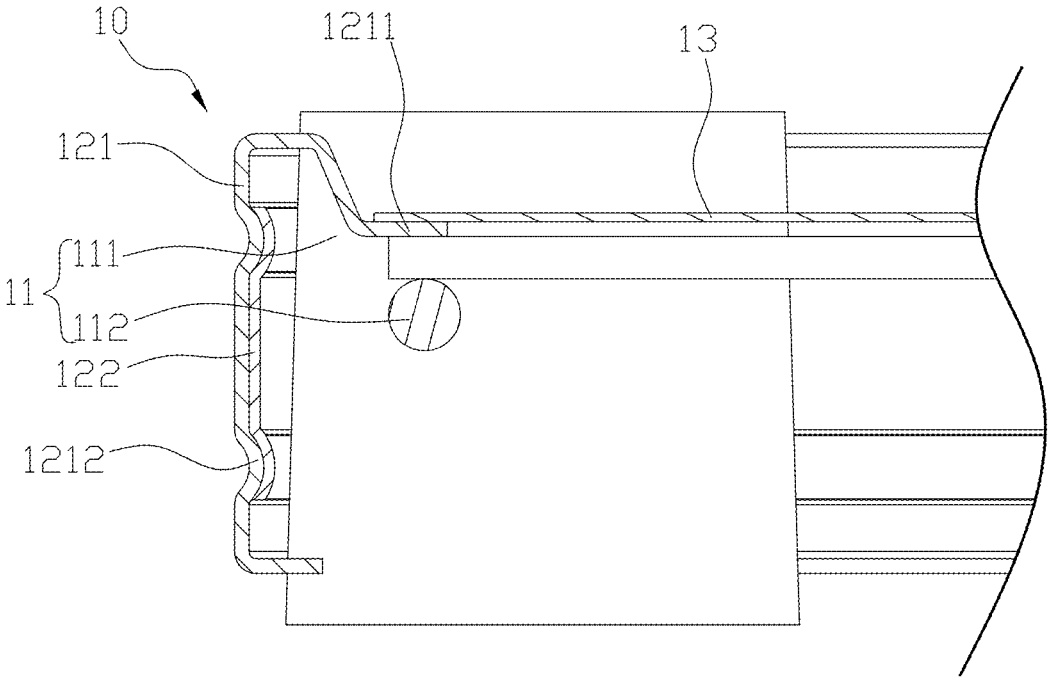
FIG. 7 is an A-A cross-sectional view of another aspect of the combining piece of the preferred embodiment according to the present invention.

Alternatively, as shown in FIG. 7, each combining piece 122 is a curved piece corresponding to the rib slots 1212, such that each combining piece 122 is capable of being welded onto an inner surface of the rib slots 1212 and the framing units 121.

Moreover, the grid layer 112 is crisscrossed comprising spaces that are in the shape of a rectangular grid.

Figure 8:
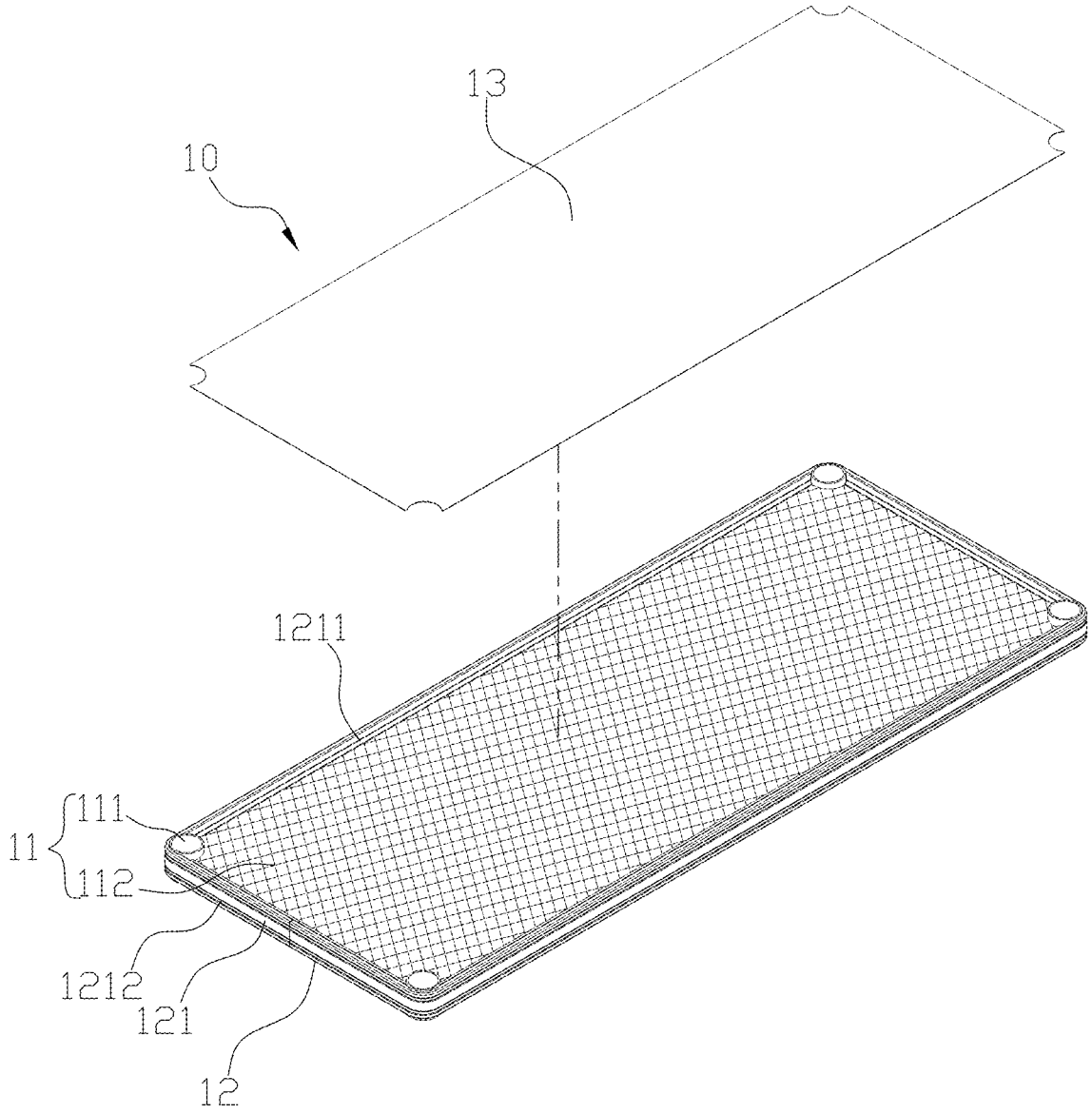
FIG. 8 is a schematic diagram of another aspect of the grid layer of the preferred embodiment according to the present invention.
Figure 9:
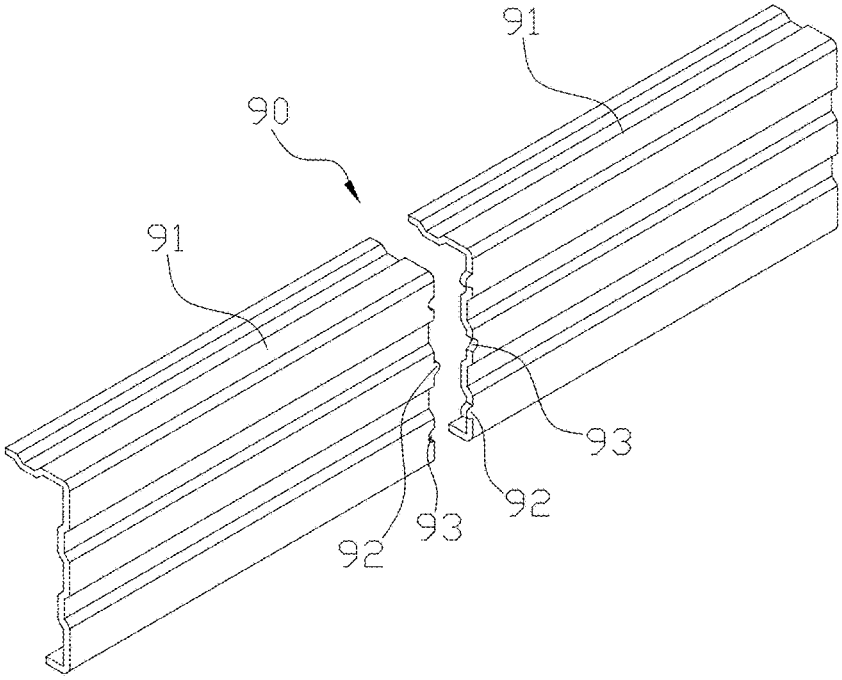
FIG. 09 PRIOR ART
FIG. 9 is a schematic diagram before the conventional frame edges are combined.
Figure 10:
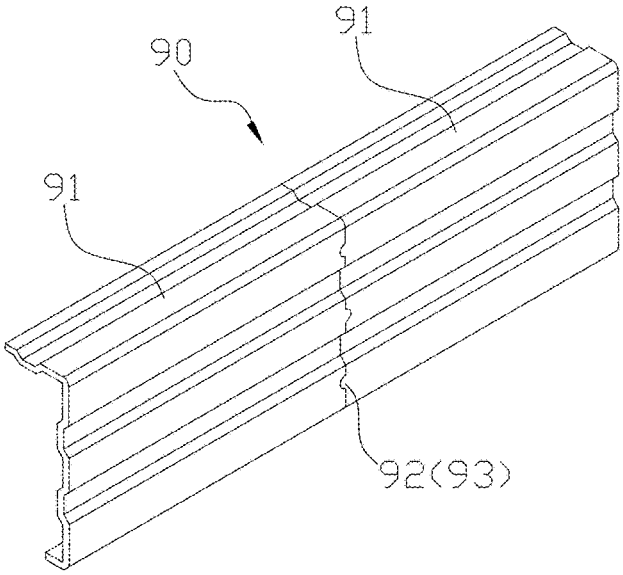
FIG. 10 PRIOR ART
FIG. 10 is a schematic diagram of the conventional frame edges are combined.

Alternatively, as shown in FIG. 8, the grid layer 112 is a diagonally staggered metal mesh.

In addition, the combining piece 122 is welded on the inner surface of the framing unit 121 through laser welding.

Also, there are four the socket rings 111, and the storage board 10 is rectangle shape.

Although the present invention has been explained in relation to its preferred embodiment, it is to be understood that many other possible modifications and variations can be made without departing from the spirit and scope of invention as hereinafter claimed.

What is claimed is:

1. A storage shelf comprising a storage board, wherein:

the storage board comprises a main body, a frame, and a layering plate, the main body having a plurality of socket rings, a grid layer horizontally disposed among the socket rings, the frame comprising a plurality of framing units, each framing unit having an edge wing lower than a top surface of the framing unit, each framing unit further comprising a rib slot on a surface of the framing unit, a plurality of combining pieces attached onto inner surfaces of the framing units and bonded to the inner surfaces to connect the plurality of framing units together; the frame further comprising a plurality of ring grooves for engaging with the socket rings; and the layering plate is a solid board and configured to be placed on the edge wings.

2. The storage shelf as claimed in claim 1, wherein each combining piece is a flat piece welded onto the inner surfaces.

3. The storage shelf as claimed in claim 1, wherein each combining piece is a curved piece corresponding to the rib slots, such that each combining piece is bonded onto inner surfaces of the rib slots and the framing units.

4. The storage shelf as claimed in claim 1, wherein the grid layer is crisscrossed comprising spaces that are in the shape of a rectangular grid.

5. The storage shelf as claimed in claim 1, wherein the grid layer is a diagonally staggered metal mesh.

* * * * *